US010736441B1

(12) United States Patent
Phy et al.

(10) Patent No.: US 10,736,441 B1
(45) Date of Patent: Aug. 11, 2020

(54) WIRE SHELF DIVIDER

(71) Applicant: Nashville Wire Products Manufacturing Company, LLC, Nashville, TN (US)

(72) Inventors: John Nicholas Phy, Pegram, TN (US); William Jacob Johnson, Spring Hill, TN (US); Jammie Todd Allbert, White Bluff, TN (US); James Thomas Baggett, Clarksville, TN (US)

(73) Assignee: Nashville Wire Products Manufacturing Company, LLC, Nashville, TN (US)

( * ) Notice: Subject to any disclaimer, the term of this patent is extended or adjusted under 35 U.S.C. 154(b) by 23 days.

(21) Appl. No.: 16/372,568

(22) Filed: Apr. 2, 2019

(51) Int. Cl.
*A47F 5/00* (2006.01)
*A47B 57/58* (2006.01)
*A47F 5/01* (2006.01)

(52) U.S. Cl.
CPC ..... *A47F 5/0056* (2013.01); *A47B 57/581* (2013.01); *A47F 5/01* (2013.01)

(58) Field of Classification Search
CPC ..... A47F 5/0056; A47F 5/01; A47F 5/005; A47F 1/12; A47F 1/121; A47B 57/581; A47L 15/505
USPC ..... 211/41.1–41.9, 181.1, 184
See application file for complete search history.

(56) References Cited

U.S. PATENT DOCUMENTS 2,841,288 A * 7/1958 Field ..... A47L 19/04 211/41.4
2,868,391 A * 1/1959 Sides ..... A47F 5/13 211/133.5
4,331,243 A * 5/1982 Doll ..... A47F 1/121 211/181.1
4,750,625 A 6/1988 Frederick
4,890,746 A 1/1990 Trulaske
(Continued)

FOREIGN PATENT DOCUMENTS

DE 3506542 A1 * 9/1986 ..... F16B 7/0493
FR 2593140 B1 * 9/1990 ..... B65D 25/06

OTHER PUBLICATIONS

Co-pending Design U.S. Appl. No. 29/686,040, filed Apr. 2, 2019 (not prior art).
Figures 1-8 of the present application are prior art.

*Primary Examiner* — Patrick D Hawn
(74) *Attorney, Agent, or Firm* — Lucian Wayne Beavers; Alex H. Huffstutter; Patterson Intellectual Property Law, PC

(57) ABSTRACT

A shelf divider apparatus and a system thereof are disclosed herein. The shelf divider apparatus is configured to attached to a wire shelf including a front top rail, a front bottom rail, a plurality of balls separating the front top and bottom rails, and a plurality of support wires supported by the front bottom rail. The shelf divider includes a first end, a second end, and a first clip connected to and extending below and away from the first end. The first clip includes a plurality of receivers defined along a lower portion of the first clip and extending perpendicularly relative to a divider length. Straight slots are defined between adjacent receivers. Each straight slot includes an enlarged opening spaced apart from a straight slot entrance for accommodating a portion of one ball of the plurality of balls so that the plurality of receivers may engage the front bottom wire.

20 Claims, 17 Drawing Sheets

(56) References Cited

U.S. PATENT DOCUMENTS

| | | | | |
|---|---|---|---|---|
| 5,082,125 | A * | 1/1992 | Ninni | A47F 5/0823 108/61 |
| 5,341,945 | A * | 8/1994 | Gibson | A47F 5/005 108/60 |
| 5,437,380 | A | 8/1995 | Peay et al. | |
| 5,607,068 | A | 3/1997 | Coretti et al. | |
| 5,645,182 | A * | 7/1997 | Miller, Jr. | A47F 1/12 108/107 |
| 6,273,276 | B1 * | 8/2001 | Upton | A47F 1/121 211/153 |
| 6,389,993 | B1 * | 5/2002 | Ondrasik | A47F 1/12 108/107 |
| 6,419,099 | B1 | 7/2002 | Weber | |
| 7,950,537 | B1 | 5/2011 | Goodman et al. | |
| 9,179,819 | B2 * | 11/2015 | Ryu | A47L 15/505 |
| 10,617,206 | B2 * | 4/2020 | Brugmann | A47B 57/588 |
| 2004/0108283 | A1 * | 6/2004 | Miilu | A47L 15/505 211/41.9 |
| 2006/0113262 | A1 | 6/2006 | Knorring et al. | |
| 2007/0080126 | A1 * | 4/2007 | Music | A47F 5/005 211/184 |

* cited by examiner

WIRE SHELF DIVIDER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

1. Field of the Invention

The present disclosure relates generally to shelving used to display retail merchandise, such as gravity-feed or horizontal shelving. More particularly, this disclosure pertains to shelving dividers and still more particularly to the attachment means employed by shelving dividers to connect shelving dividers to a shelf.

2. Description of the Prior Art

Presently, commercial display refrigerators are commonly used in grocery and convenience stores for refrigerating merchandise such as beverages placed on shelving behind glass doors which allow a shopper to view the merchandise while shopping. Two main types of shelves are used by these display refrigerators, gravity-feed shelves and horizontal shelves. Gravity-feed shelves are typically dividing into lanes using dividers.

Referring to FIGS. 1-2, a typical gravity-feed shelving system 100 is provided. The gravity-feed shelving system 100 includes a support structure 102 and at least one shelf 104 attached thereto. Each shelf of the at least one shelf 104 is identical. Accordingly, the at least one shelf 104 is referred to as the shelf 104 hereinafter. The shelf 104 is tilted forward from a rearward end 106 of the shelf 104 to a forward end 108 of the shelf 104.

The shelf 104 includes a plurality of support wires 110, a front top rail 112, a front bottom rail 114, a front retainer wire 116, and a first plurality of balls 120 separating the front top rail 112 and the front bottom rail 114. The plurality of support wires 110 are supported on the front bottom rail 114. The plurality of support wires 110 are parallel to each other and are spaced apart. The front bottom rail 114 extends below and across the plurality of support wires 110 along the forward end 108 of the shelf 104. The front retainer wire 116 is connected to an inner edge of the front bottom rail 114 closer to the rearward end 106 than to the forward end 108.

As can best be seen in FIG. 4, the shelf 104 of the gravity-feed shelving system 100 further includes a first rear bottom rail 122, a second rear bottom rail 124, a rear retainer wire 126, and a second plurality of balls 130 separating the first rear bottom rail 122 and the second rear bottom rail 124. The first rear bottom rail 122 extends below and across the plurality of support wires 110 along the rearward end 106 of the shelf 104. The plurality of support wires 110 are supported on the first rear bottom rail 122. The rear retainer wire 126 is connected to an inner edge of the first rear bottom rail 122 closer to the forward end 108 than to the rearward end 106. This arrangement of the first and second rear bottom rails 122, 124 allows for products to be placed on the shelf 104 from the rearward end 106 without being interfered with by any top wire (not shown).

As can best be seen in FIGS. 1-5, the gravity-feed shelving system 100 further includes at least one divider 140, which is commonly employed for gravity-feed shelving systems 100. Each divider of the at least one divider 140 is identical. Accordingly, the at least one divider 140 will be referred to as the divider 140 hereinafter. The divider 140 spans between the rearward end 106 and the forward end 108 of the shelf 104.

As can best be seen in FIG. 4, the divider 140 includes a first divider end 142 and a second divider end 144. The divider 140 includes a divider length 146 defined between the first divider end 142 and the second divider end 144. The divider length 146 defines a lengthwise direction 148.

The divider 140 includes a first clip 150 connected to and extending below and away from the first divider end 142. As can best be seen in FIGS. 6 and 7, the first clip 150 includes an upper portion 152 and a lower portion 154. The upper portion 152 is connected to the first divider end 142. The lower portion 154 includes a plurality of receivers 156 spaced apart perpendicularly relative to the lengthwise direction 148 to define straight slots 158 between adjacent receivers of the plurality of receivers 156. The plurality of straight slots 158 are configured to receive select support wires of the plurality of support wires 110. An outer opening 160 of each receiver of the plurality of receivers 156 is co-linear with the upper portion 152. The plurality of receivers 156 of the first clip 150 are configured to engage the front retainer wire 116. The retainer wire 116 is implemented to ensure that the first clip 150 is not interfered with by the front top rail 112.

The divider 140 further includes a second clip 170 connected to and extending below and away from the second divider end 144. The second clip 170 includes an upper portion 172 and a lower portion 174. The upper portion 172 is connected to the second divider end 144. The lower portion 174 includes a plurality of receivers 176 spaced apart perpendicularly relative to the lengthwise direction 148 to define straight slots 178 between adjacent receivers of the plurality of receivers 176. The plurality of straight slots 178 are configured to receive select support wires of the plurality of support wires 110. An outer receiver opening 180 of each receiver of the plurality of receivers 176 is co-linear with the upper portion 172. The plurality of receivers 176 of the second clip 170 are configured to engage the rear retainer wire 126.

Referring to FIG. 8, the front and rear retainer wires 116, 126 of the shelf 104 are removed. The first clip 150 of the divider 140 is shown attempting to engage the front bottom rail 114. The first plurality of balls 120 are keeping the first clip 150 from fully engaging the front bottom rail 114. Accordingly, the first clip 150 is not compatible with the shelf 104 when the front and rear retainer wires 116, 126 are removed.

Wire shelving manufactures continually strive to reduce production costs. One of the best ways to reduce production costs is to reduce the amount of material used in production. A major concern with reducing the amount of material used to produce a shelf, for example, is maintaining strength and quality. One such way that wire shelving manufactures may reduce costs without affecting strength is to remove the front and rear retainer wires 116, 126. The front and rear retainer wires 116, 126 are not structural and were merely added so that the first and second clips 150, 170 could engage the front and rear retainer wires 116, 126, respectively, without being interfered with by the first and second plurality of balls 120, 130, respectively.

As can best be seen in FIG. 8, the forward end 108 of the shelf 104 is shown with the front retainer wire 116 removed. The first clip 150 is shown as clearly being interfered with by the first plurality of balls 120 so that the plurality of receivers 156 cannot fully engage the front bottom rail 114.

BRIEF DESCRIPTION

Accordingly, there exists a need for wire shelving manufactures to reduce costs. The present disclosure provides a new divider clip that is capable of engaging either the front or rear bottom wire without being interfered with by the plurality of balls. The new divider clip allows shelving manufacturers to eliminate the previously implemented front and rear retainer wires. The elimination of the front and rear retainer wires reduces production costs for manufacturers. The new divider clip was also designed to be backwards compatible so that it can work with both new (e.g., does not have retainer wires) and old (e.g., has retainer wires) wire shelving alike. This provides wire shelving customers additional options when incrementally updating or upgrading their shelving systems while also allowing the wire shelving manufacturer to only produce one type of wire divider that is universally compatible with both their old and new wire shelves.

According to one aspect of the present disclosure, there is provided a shelving system comprised of a shelf, an elongated divider, and a first clip. The shelf includes a front top rail, a front bottom rail, a first plurality of balls separating the front top rail and the front bottom rail, and a plurality of support wires supported on the front bottom rail. The plurality of support wires are positioned parallel to each other and are spaced apart. The elongated divider includes a first divider end and a second divider end. The elongated divider further includes a divider length defined between the first and second divider ends. The first clip is connected to and extends below and away from the first divider end of the elongated divider. The first clip includes at least an upper portion and a lower portion. The upper portion is connected to the first divider end. The lower portion includes a plurality of receivers directed away from the elongated divider and is configured to engage the front bottom rail. The plurality of receivers are spaced apart perpendicularly relative to the divider length to define straight slots between adjacent receivers of the plurality of receivers. Each straight slot includes a slot entrance and a slot width. Each straight slot further includes an enlarged opening. Each enlarged opening is spaced apart from the slot entrance of each straight slot. Each enlarge opening includes an opening width larger than the slot width.

According to another aspect of the shelving system of the present disclosure, each enlarged opening may be configured to accommodate at least a portion of one of the first plurality of balls so that the plurality of receivers may engage the front bottom rail.

According to another aspect of the shelving system of the present disclosure, the enlarged opening may be partially circular so that it is configured to clear a portion of one ball of the first plurality of balls.

According to another aspect of the shelving system of the present disclosure, the slot width may be greater than or equal to 3 mm and is less than or equal to 13 mm.

According to another aspect of the shelving system of the present disclosure, the opening width of the enlarged opening may be greater than or equal to 4 mm and is less than or equal to 14 mm.

According to another aspect of the shelving system of the present disclosure, adjacent wires of the plurality of support wires of the shelf may be evenly spaced apart by a wire spacing width. Each receiver of the plurality of receivers may include a receiver width parallel to the slot width. A summation of the slot width and the receiver width of one receiver of the plurality of receivers may substantially equal to the wire spacing width.

According to another aspect of the shelving system of the present disclosure, the straight slots defined by adjacent receivers of the plurality of receivers may be configured to receive adjacent support wires of the plurality of support wires.

According to another aspect of the shelving system of the present disclosure, the divider length defines a lengthwise direction. The upper portion of the first clip may extend from the first divider end of the elongated divider at a first angle relative to the lengthwise direction so that the upper portion engages a lower rail portion of the front top rail.

According to another aspect of the shelving system of the present disclosure, the first clip may include an intermediate portion defined between the upper and lower portions of the first clip. The intermediate portion may extend at a second angle relative to the lengthwise direction. The second angle may be greater than the first angle. Finally, a majority of each enlarged opening may be defined along the intermediate portion so that the enlarged opening is positioned for receiving one ball of the first plurality of balls.

According to another aspect of the shelving system of the present disclosure, each receiver of the plurality of receivers may include a receiver opening directed away from the elongated shelf. The receiver opening may be positioned at a third angle relative to the lengthwise direction. The third angle may be less than the first angle.

According to another aspect of the shelving system of the present disclosure, the plurality of receivers may be configured to span between an upper rail portion of the front bottom rail and a lower rail portion of the front bottom rail.

According to another aspect of the shelving system of the present disclosure, the shelf may further include a rear top rail, a rear bottom rail, and a second plurality of balls separating the rear top rail from the rear bottom rail. The rear bottom rail may extend below and across the plurality of support wires. The plurality of support wires are supported on the rear bottom wire. The elongated divider may further include a second clip connected to and extending below and away from the second divider end of the elongated divider. The second clip may be configured to engage the rear bottom rail.

According to another aspect of the shelving system of the present disclosure, the second clip may extend opposite the first clip. The second clip may be connected to and may extend below and away from the second divider end of the elongated divider. The second clip may include at least an upper portion and a lower portion. The upper portion may be connected to the second divider end. The lower portion may include a plurality of receivers directed away from the elongated divider and be configured to engage the front bottom rail. The plurality of receivers may be spaced apart perpendicularly relative to the divider length to define straight slots between adjacent receivers of the plurality of receivers. Each straight slot may include a slot entrance and a slot width. Each straight slot may further include an enlarged opening. Each enlarged opening may be spaced apart from the entrance of each straight slot. Each enlarged opening may include an opening width larger than the slot width.

According to further aspects of the present disclosure, there is provided a shelf divider comprised of an elongated divider and a first clip. The elongated divider includes first and second ends. The elongated divider further includes a divider length defined between the first and second ends. The first clip is connected to the first end of the elongated divider and extends below and away from the first end of the elongated divider. The first clip includes a plurality of C-shaped receivers positioned along a lower portion of the first clip facing away from the elongated divider. The plurality of C-shaped receivers are spaced apart perpendicularly relative to the divider length to define straight slots between adjacent C-shaped receivers of the plurality of C-shaped receivers. Each straight slot includes a slot entrance and a slot width. A partially circular opening is in communication with each straight slot. Each partially circular opening is spaced apart from the entrance of each straight slot and has an opening diameter greater than the slot width.

According to another aspect of the shelf divider of the present disclosure, the plurality of C-shaped receivers may be offset perpendicularly by an offset distance from a plane defined along a first lower edge of the elongated divider adjacent to the first end. According to another aspect of the shelf divider of the present disclosure, the offset distance may be greater than or equal to 4 mm.

According to another aspect of the shelf divider of the present disclosure, the plurality of C-shaped receivers may be offset perpendicularly by an offset distance from a plane defined tangential to the first end of the elongated divider and perpendicularly to the divider length. According to another aspect of the shelf divider of the present disclosure, the offset distance may be greater than or equal to 4 mm.

According to another aspect of the shelf divider of the present disclosure, the slot width of the straight slot may be greater than or equal to 3 mm and less than or equal to 13 mm.

According to another aspect of the shelf divider of the present disclosure, the opening diameter of the partially circular opening may be greater than or equal to 4 mm and less than or equal to 14 mm.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
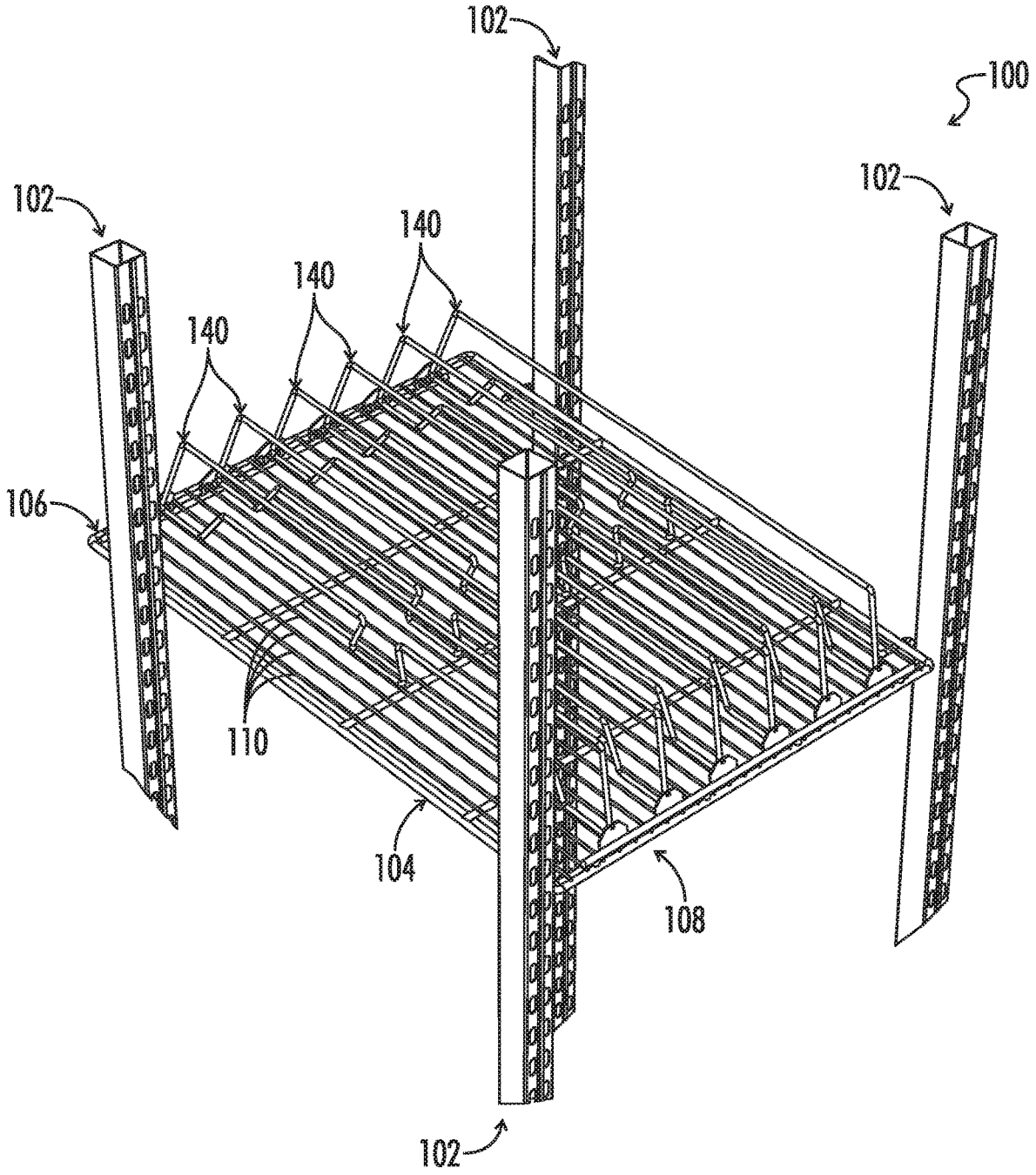
FIG. 1 (PRIOR ART)
FIG. 1 illustrates a perspective view of a prior art gravity-feed shelving system.
Figure 2:
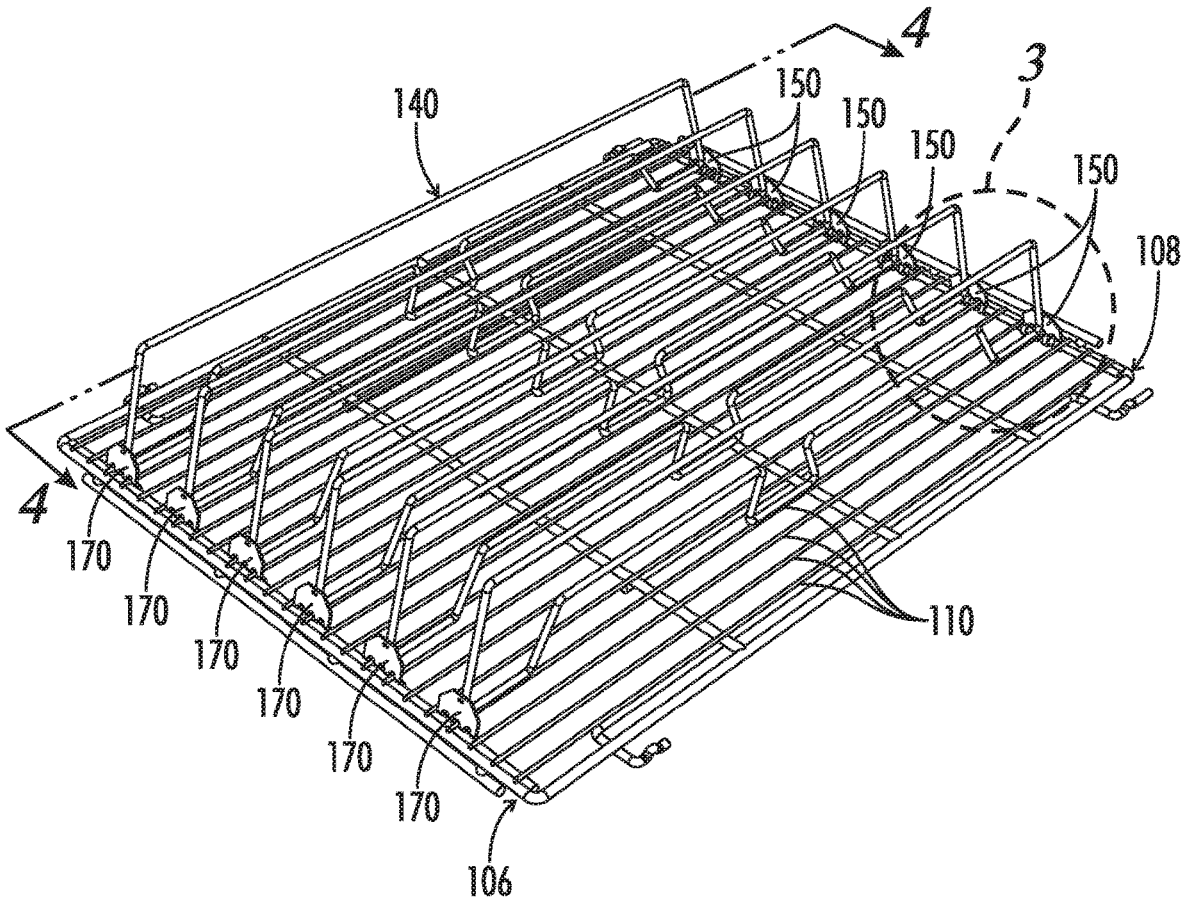
FIG. 2 (PRIOR ART)
FIG. 2 illustrates a perspective view of a shelf and dividers of the gravity-feed shelving system of FIG. 1.
Figure 3:
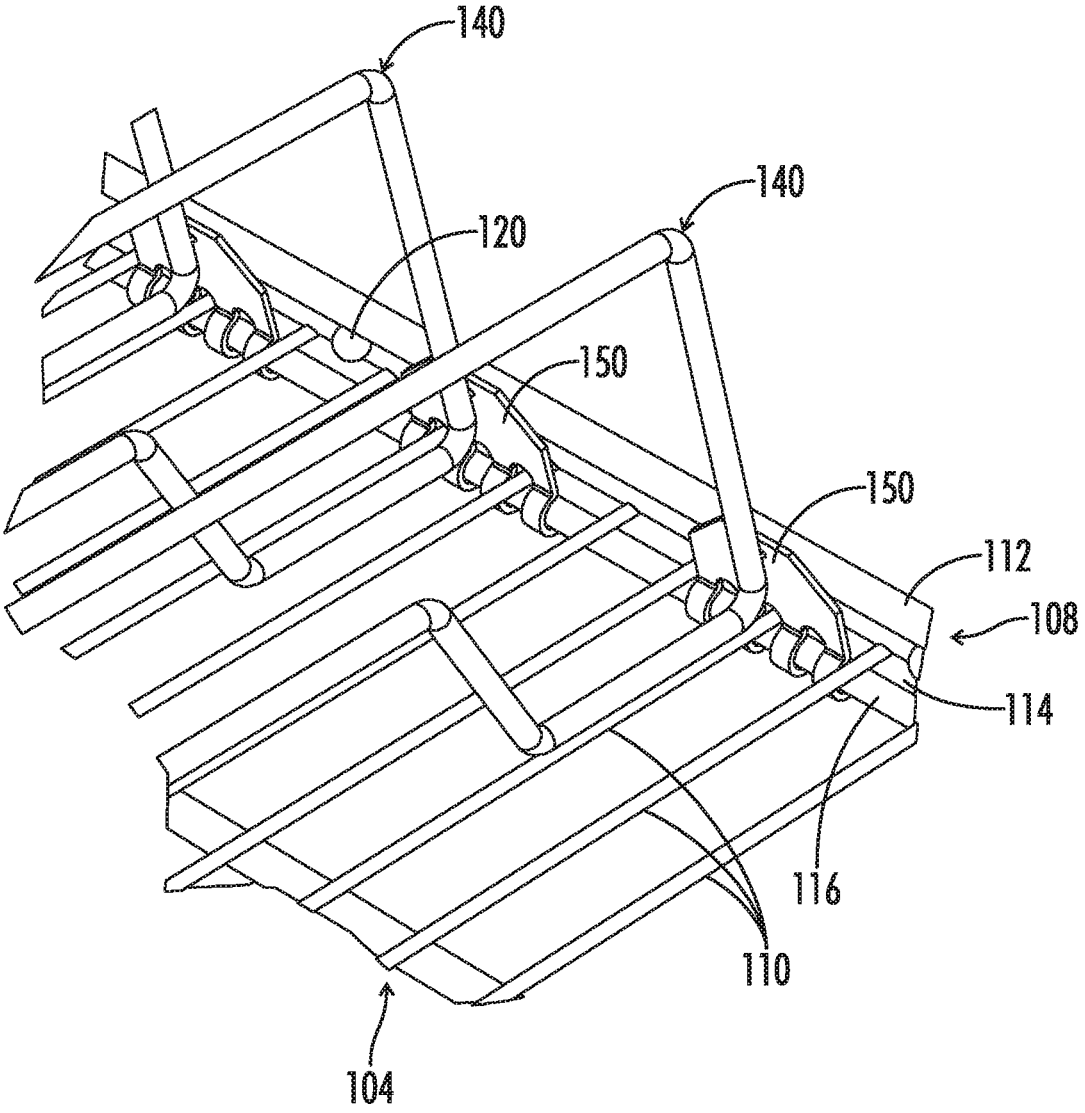
FIG. 3 (PRIOR ART)
FIG. 3 illustrates an enlarged perspective view of the shelf and dividers of FIG. 2 taken of area 3 of FIG. 2.
Figure 4:
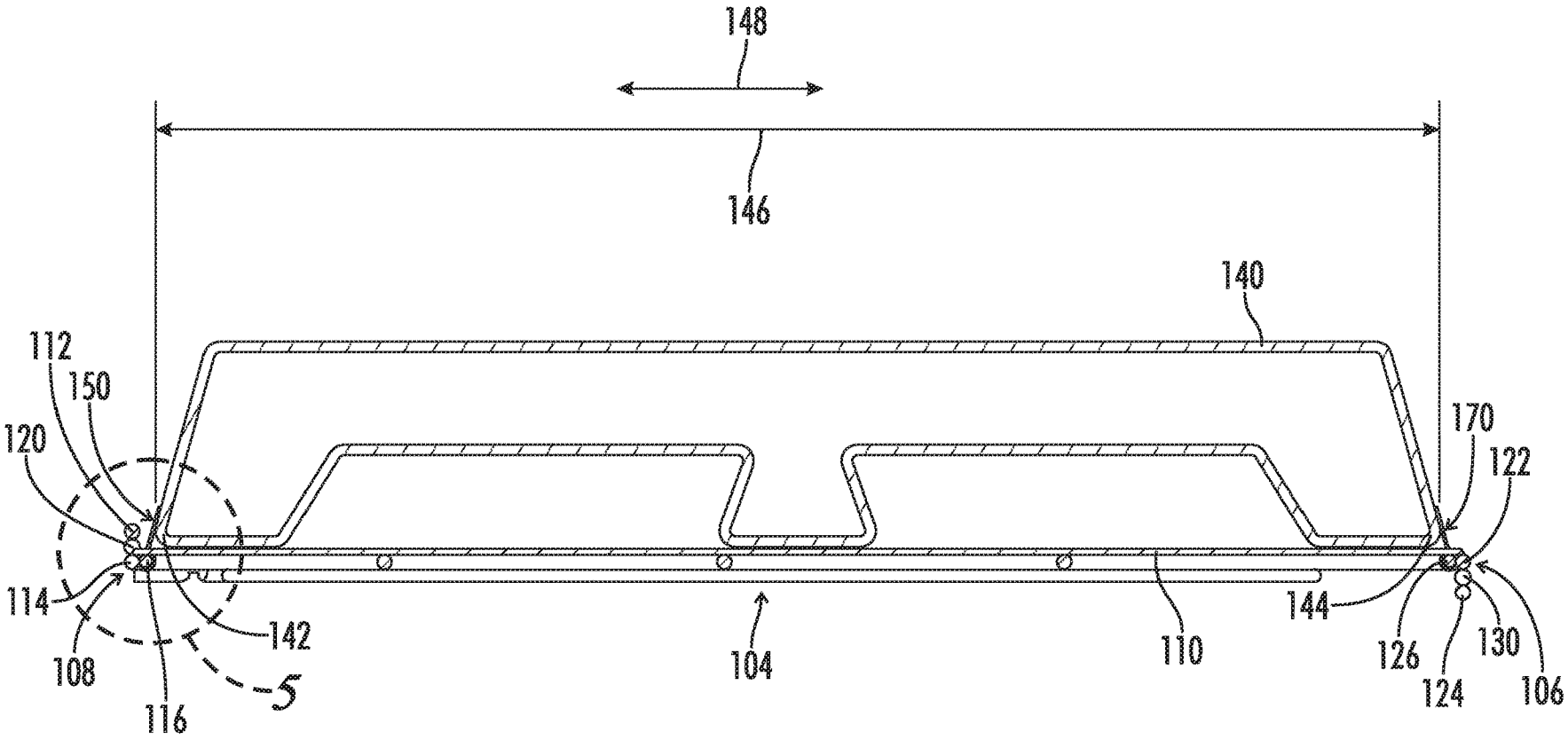
FIG. 4 (PRIOR ART)
FIG. 4 illustrates a cross-sectional view of the shelf and dividers of FIG. 2 taken along line 4-4 of FIG. 2.
Figure 5:
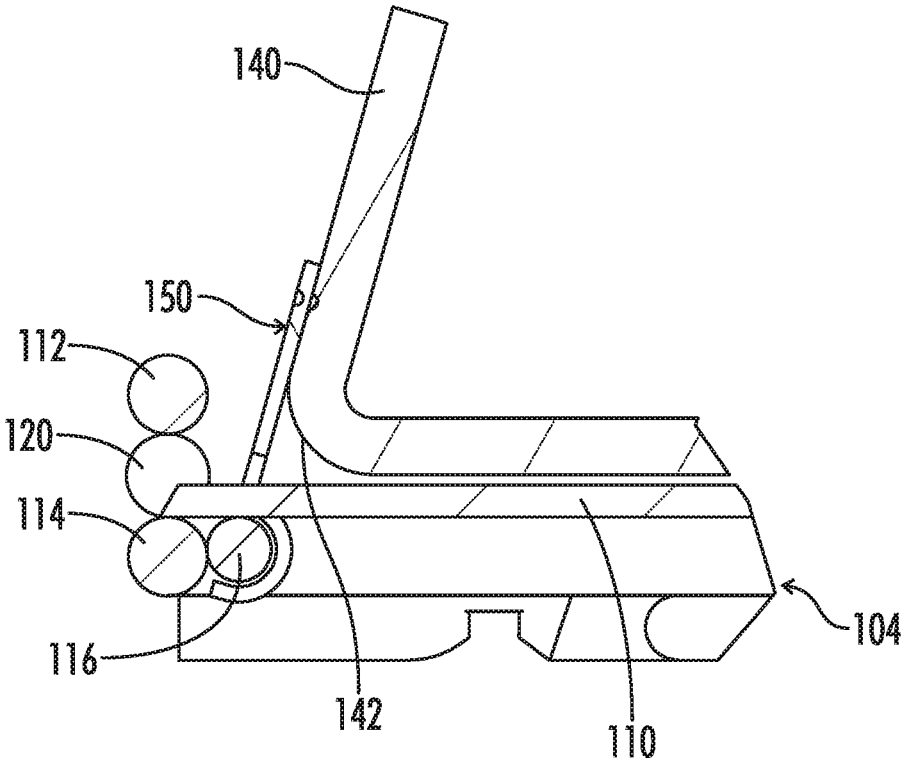
FIG. 5 (PRIOR ART)
FIG. 5 illustrates an enlarged cross-sectional view of the shelf and dividers of FIG. 4 taken of area 5-5 of FIG. 4.
Figure 6:
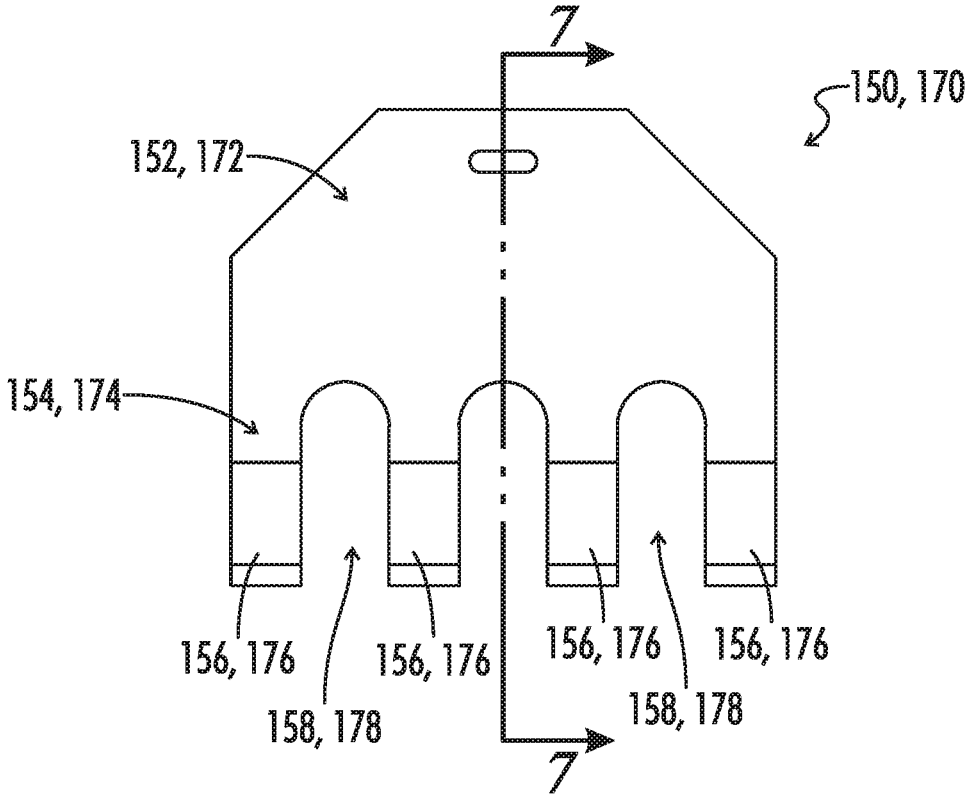
FIG. 6 (PRIOR ART)
FIG. 6 illustrates a front elevational view of a clip of one of the dividers of FIG. 2.
Figure 7:
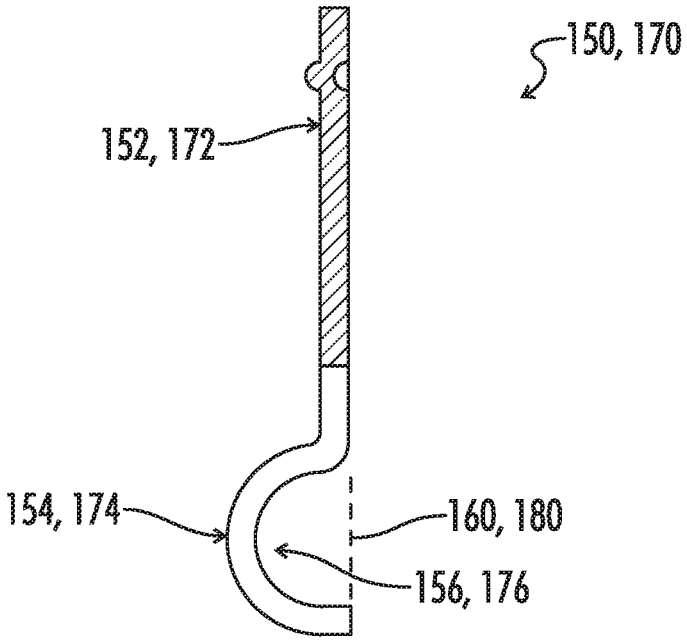
FIG. 7 (PRIOR ART)
FIG. 7 illustrates a cross-sectional view of the clip of FIG. 6 taken along line 7-7 of FIG. 6.
Figure 8:
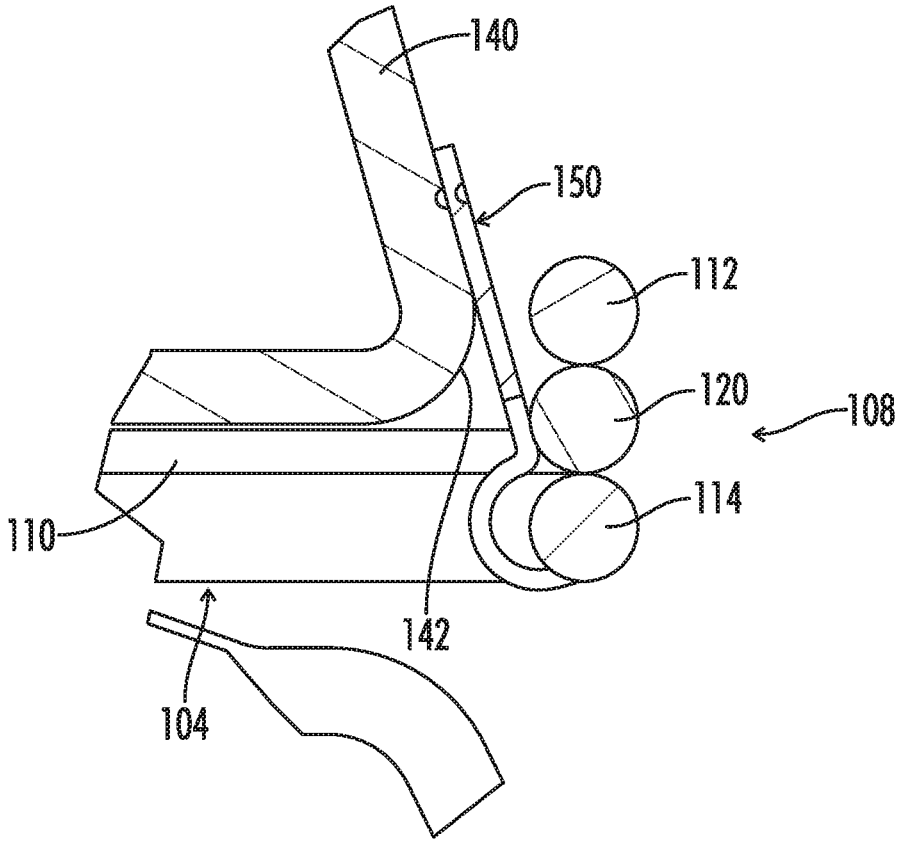
FIG. 8 (PRIOR ART)
FIG. 8 illustrates an enlarged cross-sectional view of the divider of FIG. 5 engaging an embodiment of the shelf with a retainer wire removed.
Figure 9:
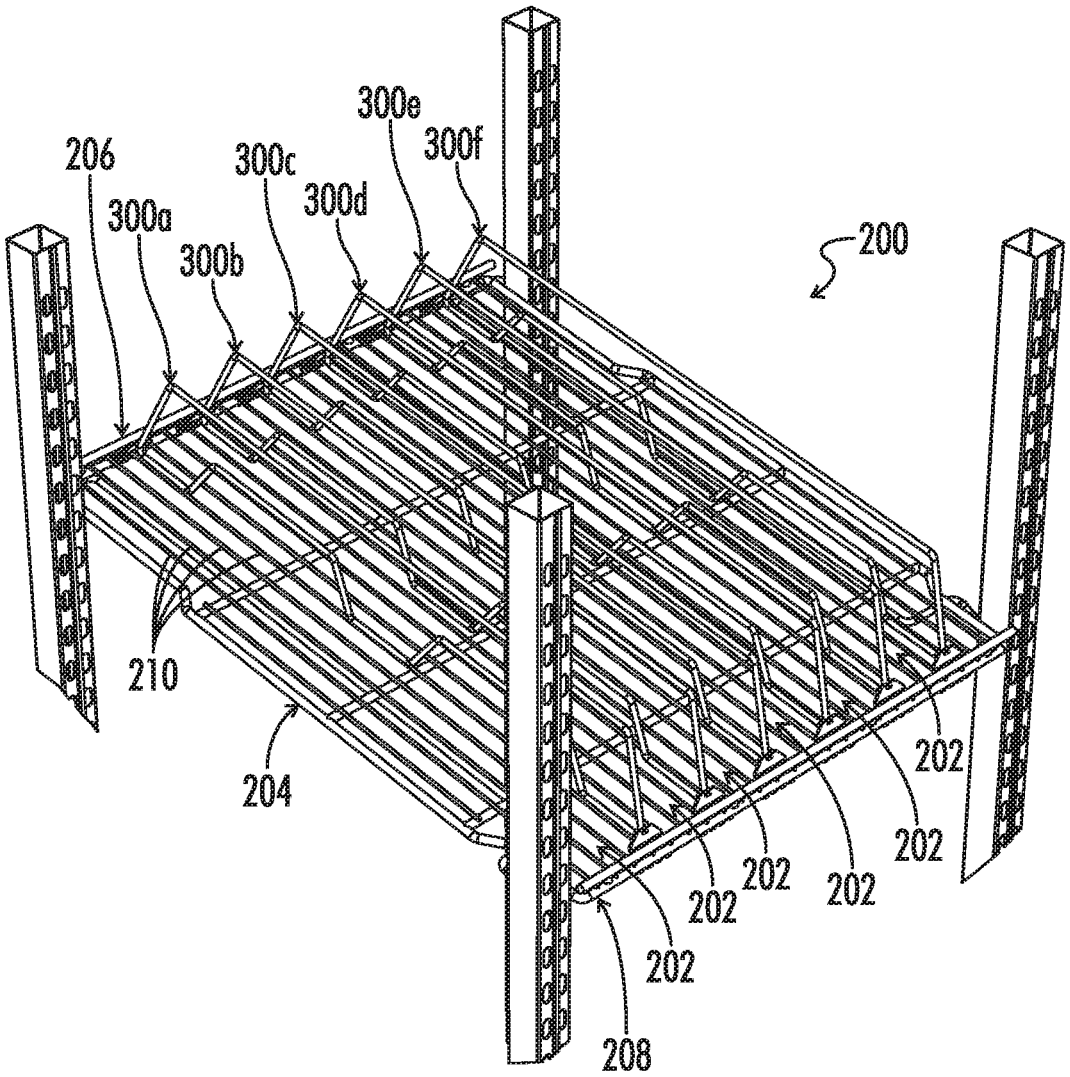
FIG. 9 illustrates a perspective view of a shelving system in accordance with the present disclosure.

Referring to FIGS. 9-12, a shelving system 200 is provided. The shelving system includes a shelf 204 and a shelf divider apparatus 300. As can best be seen in FIG. 9, multiple divider apparatuses (e.g., 300*a*, 300*b*, 300*c*, etc.) may be used to divide the shelf 204 into a plurality of lanes 202 spanning between a rearward shelf end 206 and a forward shelf end 208. The shelving system 200 may further be connected to a support structure, as shown in FIG. 9.

Figure 10:
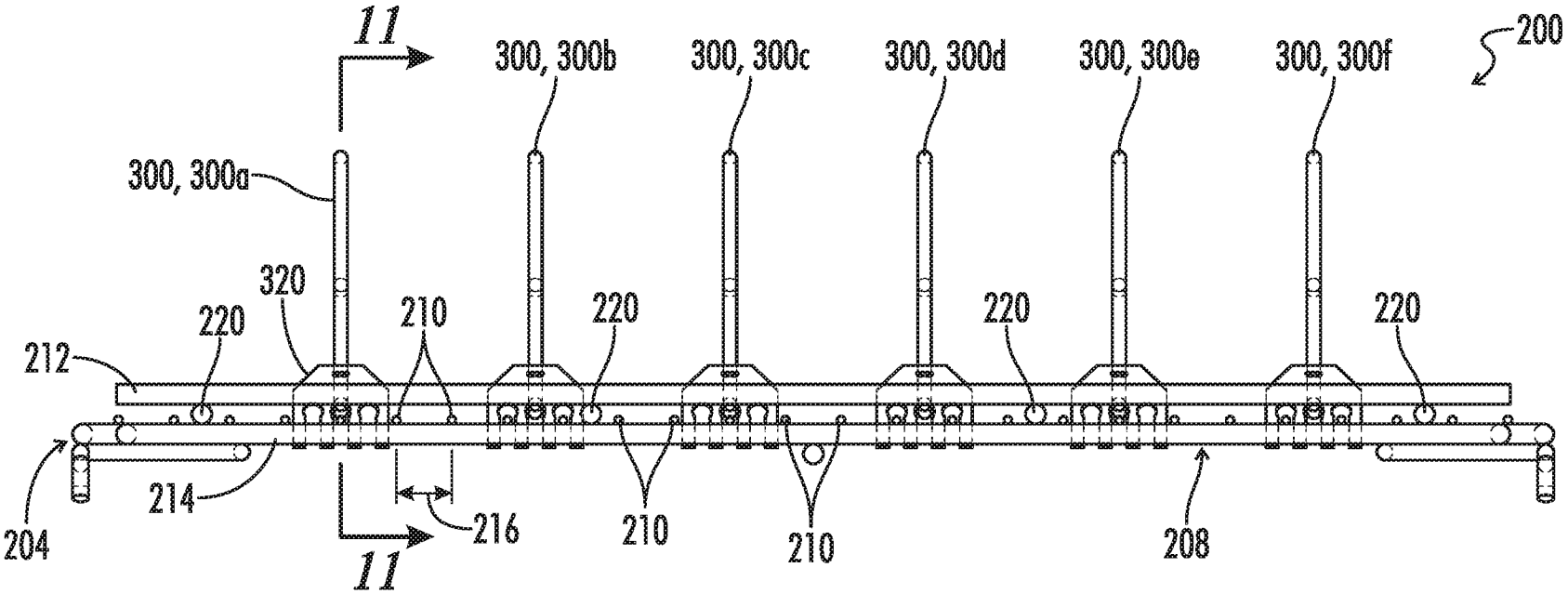
FIG. 10 illustrates a front elevational view of the shelving system of FIG. 9.

As can best be seen in FIG. 10, the shelf 204 comprises a plurality of support wires 210, a front top rail 212, a front bottom rail 214, and a first plurality of balls 220 separating the front top rail 212 and the front bottom rail 214. The front top rail 212 may also be referred to herein as a front top wire 212. The front bottom rail 214 may also be referred to herein as a front bottom wire 214. The plurality of support wires 210 are supported on the front bottom rail 214. The plurality of support wires 210 are positioned parallel to each other and are spaced apart.

In certain embodiments, the plurality of support wires 210 may be evenly spaced apart according to a wire spacing width 216. The wire spacing width 216 may also be referred to herein as a support wire spacing distance 216. The front bottom rail 214 may extend below and across the plurality of support wires 210. The front top rail 212 and the front bottom rail 214 may span the forward shelf end 208.

Figure 11:
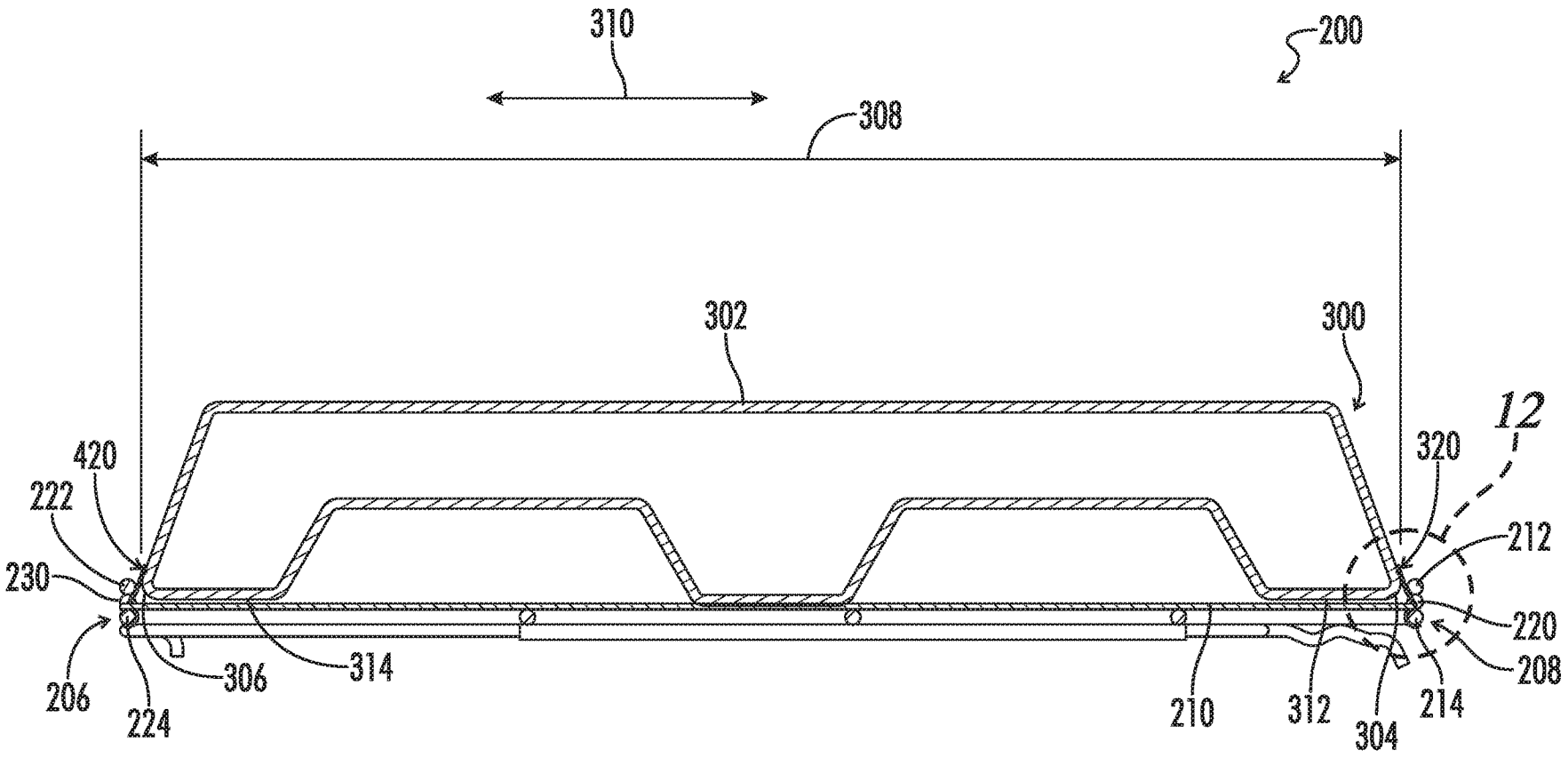
FIG. 11 illustrates a cross-sectional view of the shelving system of FIG. 9 taken along line 11-11 of FIG. 10.

As can best be seen in FIG. 11, the shelf 204 may further comprise a rear top rail 222, a rear bottom rail 224, and a second plurality of balls 230 separating the rear top rail 222 and the rear bottom rail 224. The rear top rail 222 may also be referred to herein as a rear top wire 222. The rear bottom rail 224 may also be referred to herein as a rear bottom wire 224. The rear bottom rail 224 may extend below and across the plurality of support wires 210. The plurality of support wires 210 are supported on the rear bottom rail 224. The rear top rail 222 and the rear bottom rail 224 may span the rearward shelf end 206.

In the illustrated embodiment, the first plurality of balls 220 are spaced apart from each other and the second plurality of balls 230 are spaced apart from each other. The use of the first plurality of balls 220 and the second plurality of balls 230 provides cost reductions as compared with alternative spacing options that may use an additional wire (not shown) for spacing the rear top rail 222 apart from the rear bottom rail 224.

As can best be seen in FIGS. 9-13, the shelf divider apparatus 300 comprises an elongated divider 302 and a first clip 320 connected to the elongated divider 302. The elongated divider 302 may also be referred to herein as a divider 302. As can best be seen in FIG. 11, the elongated divider 302 includes a first divider end 304 and a second divider end 306. The first divider end 304 may also be referred to herein as a first end 304. The second divider end 306 may also be referred to herein as a second end 306. The elongated divider 302 further includes a divider length 308 defined between the first divider end 304 and the second divider end 306. The divider length 308 defines a lengthwise direction 310. The elongated divider 302 may include a first lower edge 312 and a second lower edge 314. The first lower edge 312 may be defined adjacent to the first divider end 304. The second lower edge 314 may be defined adjacent to the second divider end 306. The first and second lower edges 312, 314 may be colinear.

The elongated divider 302 may be open such as when formed from metal wire. In other embodiments, the elongated divider 302 may be solid such as when formed from metal plating. In other embodiments, the elongated divider 302 may be formed from any suitable material such as plastics, wood, composites, metals, or the like.

Figure 12:
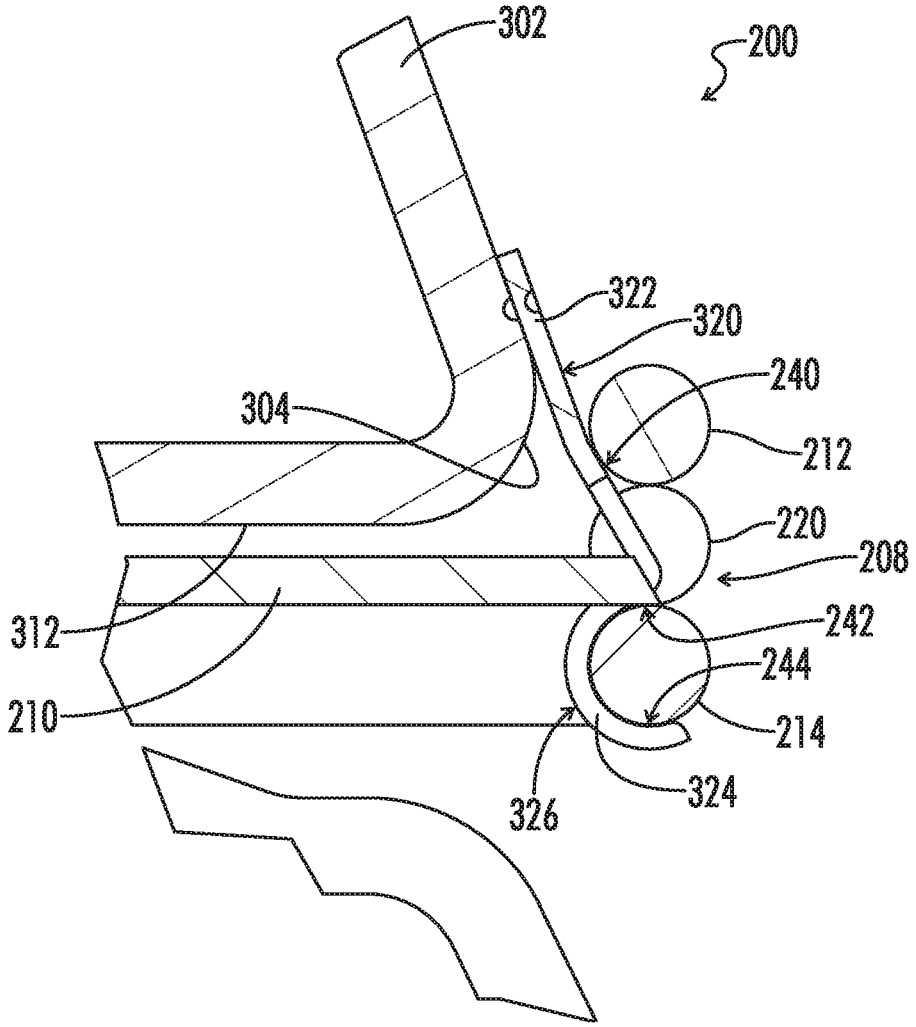
FIG. 12 illustrates an enlarged cross-sectional view of the shelving system of FIG. 9 taken of area 12 of FIG. 11.

As can best be seen in FIGS. 10-12, the first clip 320 is connected to the first divider end 304 of the elongated divider 302. The first clip 320 extends below and away from the first divider end 304. As can best be seen in FIGS. 12 and 14-16, the first clip 320 includes at least an upper portion 322 and a lower portion 324. The upper portion 322 may also be referred to herein as an upper clip portion 322. The lower portion 324 may also be referred to herein as a lower clip portion 324. The upper portion 322 is connected to the first divider end 304 of the elongated divider 302.

As can best be seen in FIGS. 12-16, the lower portion 324 includes a plurality of receivers 326 directed away from the elongated divider 302. The plurality of receivers 326 may also be referred to herein as a plurality of C-shaped receivers 326. The plurality of receivers 326 are configured to engage the front bottom rail 214. The plurality of receivers 326 comprises at least two receivers. As can best be seen in FIG. 15, the plurality of receivers 326 are spaced apart perpendicularly relative to the lengthwise direction 310 to define straight slots 328 between adjacent receivers of the plurality of receivers 326. Each straight slot 328 includes a slot entrance 330 and a slot width 332. Each slot entrance 330 may be configured to receive one of the plurality of support wires 210 of the shelf 204. The slot width 322 of each slot is greater than or equal to 3 mm and is less than or equal to 13 mm.

Each straight slot 328 further includes an enlarged opening 334 spaced apart from the slot entrance 330. The enlarged opening 334 may also be referred to herein as a partially circular opening 334. Each enlarged opening 334 includes an opening width 336 that is larger than the slot width 332. Because the enlarged openings 334 may be partially circular, the opening width 336 may also be referred to herein as a diameter 336. Each enlarged opening 334 is configured to accommodate at least a portion of one of the first plurality of balls 220 so that the plurality of receivers 326 are able to fully engage the front bottom rail 214. The opening width 336 of each enlarged opening 334 is greater than or equal to 4 mm and is less than or equal to 14 mm. In an embodiment, the opening width 336 may preferably be within a range of 50% to 500% greater than the slot width 322.

Figure 15:
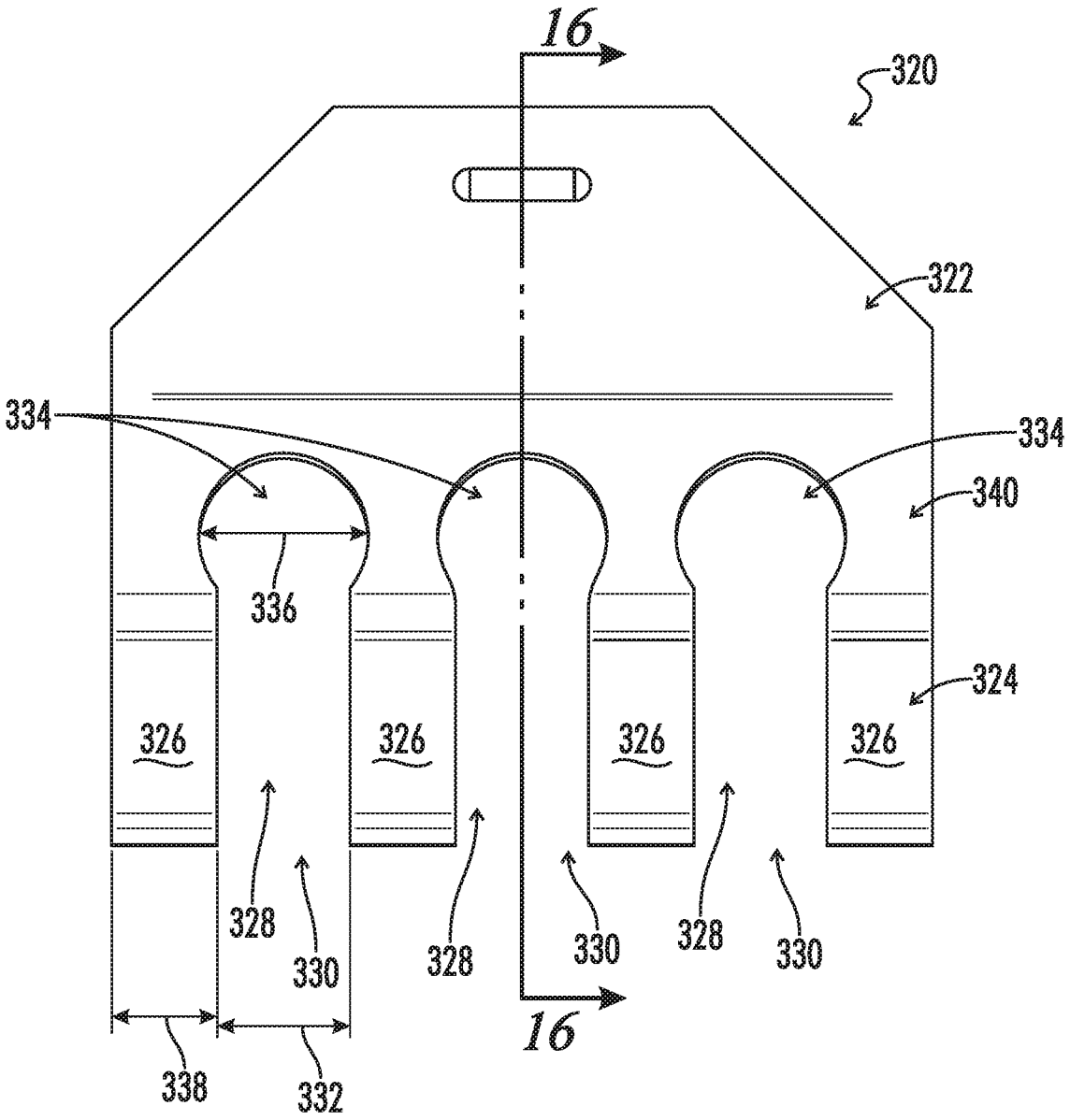
FIG. 15 illustrates a front elevational view of a first clip of the shelving system of FIG. 9 in accordance with the present disclosure.

As can best be seen in FIG. 15, each receiver of the plurality of receivers 326 includes a receiver width 338 defined parallel to the slot width 332. The wire spacing width 216 of the plurality of support wires 210 of the shelf 204 is a multiple (e.g., 1×, 2×, etc.) of a summation of the slot width 332 of one of the straight slots 328 and the receiver width 338 of one of the plurality of receivers 326.

Figure 14:
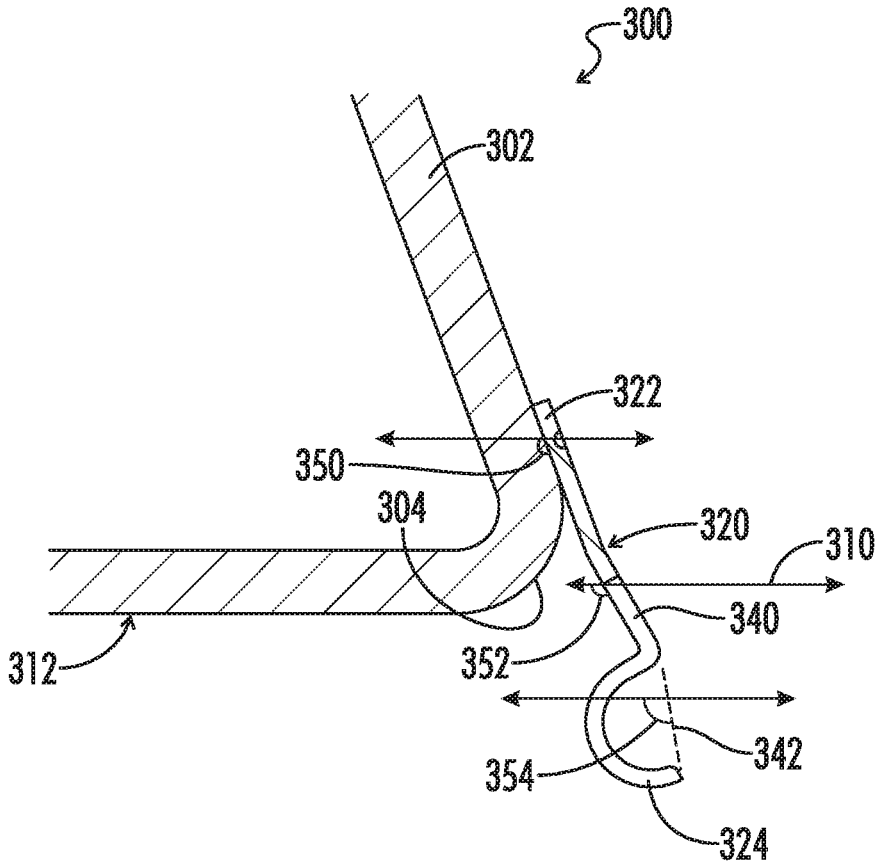
FIG. 14 illustrates an enlarged cross-sectional view of the shelf divider apparatus of FIG. 13 taken of area 14 of FIG. 13.

As can best be seen in FIG. 14, the upper portion 322 of the first clip 320 may extend from the first divider end 304 at a first angle 350 relative to the lengthwise direction 310. The upper portion 322 is configured to engage a lower rail portion 240 (FIG. 12) of the front top rail 212.

Figure 16:
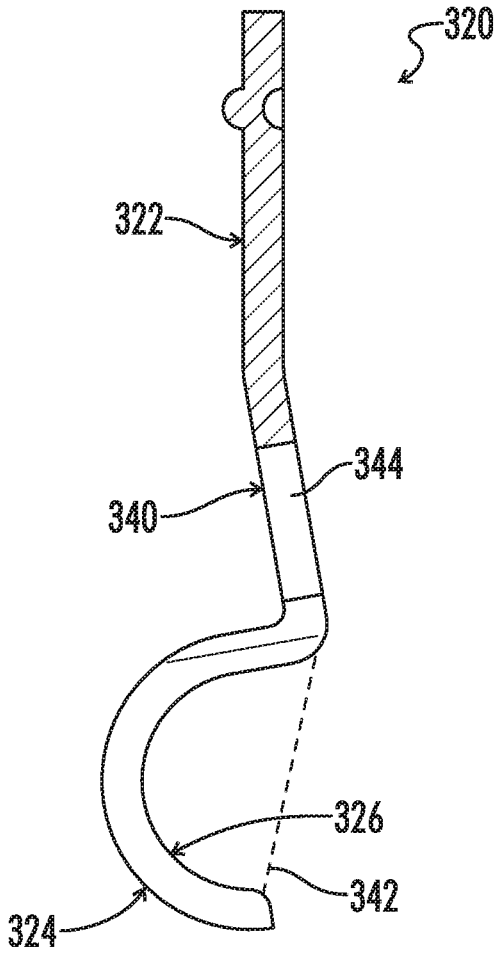
FIG. 16 illustrates a cross-sectional view of the first clip of FIG. 15 taken along line 16-16 of FIG. 15.

As can best be seen in FIGS. 14-16, the first clip 320 may further include an intermediate portion 340 defined between the upper portion 322 and the lower portion 324. As can best be seen in FIG. 14, the intermediate portion 340 extends from a lower end of the upper portion 322 at a second angle 352 relative to the lengthwise direction 310. The second angle 352 is greater than the first angle 350. The second angle 352 of the intermediate portion 340 enables the intermediate portion 340 to reach between the front top rail 212 and the front bottom rail 214 of the shelf 204. A majority of each enlarged opening 334 is defined along the intermediate portion 340 so that the enlarged opening 334 is positioned for receiving one ball of the first plurality of balls 220.

Each receiver of the plurality of receivers 326 includes a receiver opening 342 directed away from the elongated divider 302. As can best be seen in FIG. 14, each receiver opening 342 of each of the plurality of receivers 326 is the entry point at which the front bottom rail 214 is received by the plurality of receivers 326. The receiver opening 342 is positioned at a third angle 354 relative to the lengthwise direction 310. In other words, an imaginary line between the upper end of the receiver opening 342 and the lower end of the receiver opening 342 is positioned at the third angle 354 relative to the lengthwise direction 310. The third angle 354 is less than the first angle 350. The third angle 354 enables the plurality of receivers 326 to span between an upper rail portion 242 (FIG. 12) of the front bottom rail 214 and a lower rail portion 244 (FIG. 12) of the front bottom rail 214 when the plurality of receivers 326 engage the front bottom rail 214.

In the exemplary embodiment, as illustrated, the first angle 350 is approximately 110 degrees relative to the lengthwise direction 310, the second angle 352 is approximately 130 degrees relative to the lengthwise direction 310, and the third angle 354 is approximately 109 degrees relative to the lengthwise direction 310. One of skill in the art will appreciate that these angles (e.g., the first, second, and third angles 350, 352, 354) may be adjusted by up to 33% while still allowing the first clip 320 to be effective at engaging the front bottom rail 214 while accommodating the first plurality of balls 220.

Figure 13:
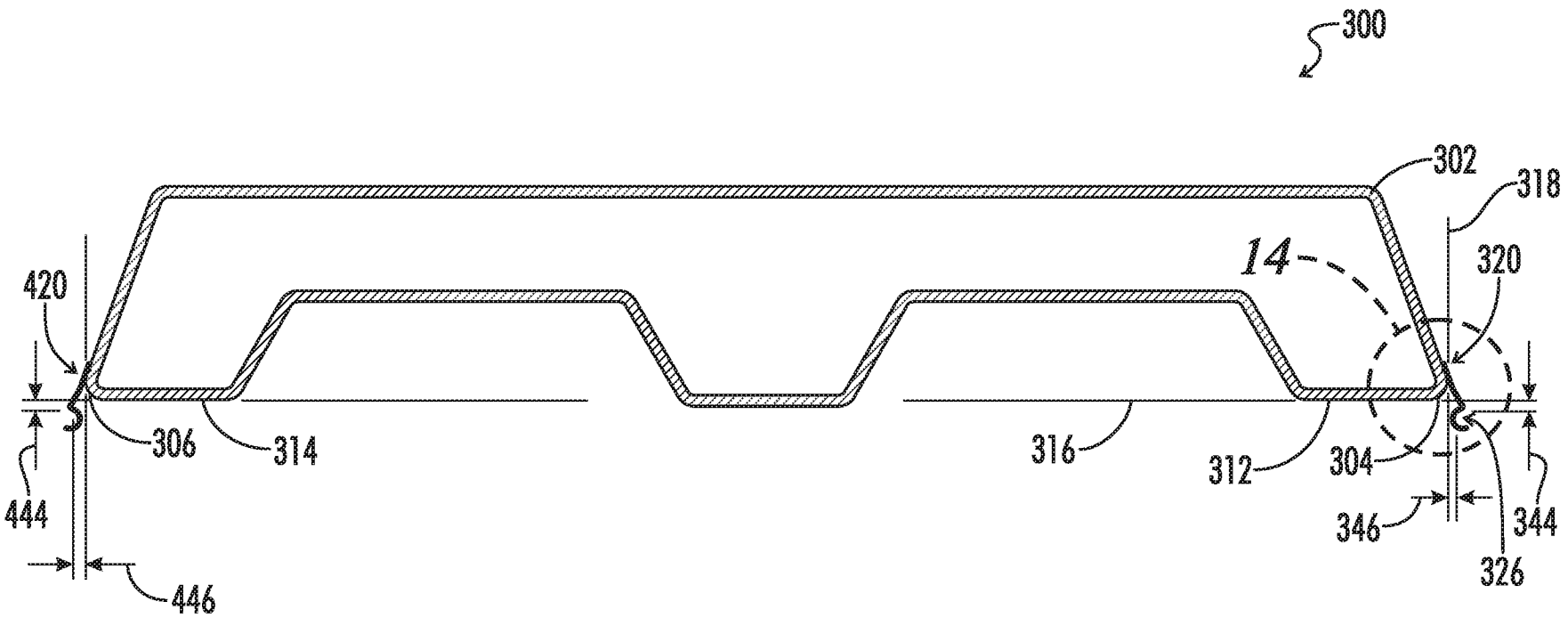
FIG. 13 illustrates a side elevational view of a shelf divider apparatus of the shelving system of FIG. 11 in accordance with the present disclosure.

As can best be seen in FIG. 13, the plurality of receivers 326 of the first clip 320 are offset perpendicularly from a horizontal plane 316 by an offset distance 344. The plane 316 is defined by the first lower edge 312 of the elongated divider 302. The offset distance 344 may be defined between the plane 316 and a proximate portion of an interior surface of each receiver of the plurality of receivers 326. In an exemplary embodiment, the offset distance 344 is greater than or equal to 4 mm. The offset 344 may allow the plurality of receivers 326 adequate reach to get under the plurality of support wires 210 without the first lower edge 312 interfering with the plurality of receivers 326 engaging the front bottom rail 214.

The plurality of receivers 326 of the first clip 320 are also offset perpendicularly from a plane 318 by an offset distance 346. The plane 318 is defined tangential to the first divider end 304 of the elongated divider 302. The plane 318 is positioned perpendicular to both the divider length 308 and the lengthwise direction 310. The offset distance 346 may be defined between the plane 318 and a proximate portion of the interior surface of each receiver of the plurality of receivers 326. In an exemplary embodiment, the offset distance 346 is greater than or equal to 4 mm. The offset distance 346 may enable the plurality of receives 326 adequate reach to engage the front bottom rail 214 without being interfered with or interfering with any other potential attachments (not shown) connected to the front top rail 212 and/or the front bottom rail 214.

As can best be seen in FIGS. 11 and 13, the shelf divider apparatus 300 may further comprise a second clip 420 connected to the second divider end 306 of the elongated divider 302. The second clip 420 is connected to and extends below and away from the second divider end 306 of the elongated divider 302. As illustrated, the second clip 420 is configured to engage the rear bottom rail 224 of the shelf 204. The second clip 420 is an identical mirror image of the first clip 320. In other embodiments (not shown), however, the second clip 420 may be different from the first clip 320 and may connect proximate to the rearward shelf end 206 using a different connection means. In still further embodiments (not shown), the first clip 320 may be configured to connect with the rear bottom rail 224 and the second clip 420 may connect proximate to the forward shelf end 208 using a different connection means.

Elements of the second clip 420 are numbered similarly to elements of the first clip 320, except the first digit of the element number is a "4" instead of a "3". As illustrated, the second clip 420 is an identical mirror image of the first clip 320 extending from the opposite end (e.g., the second divider end 306) of the elongated divider 302.

Figure 17:
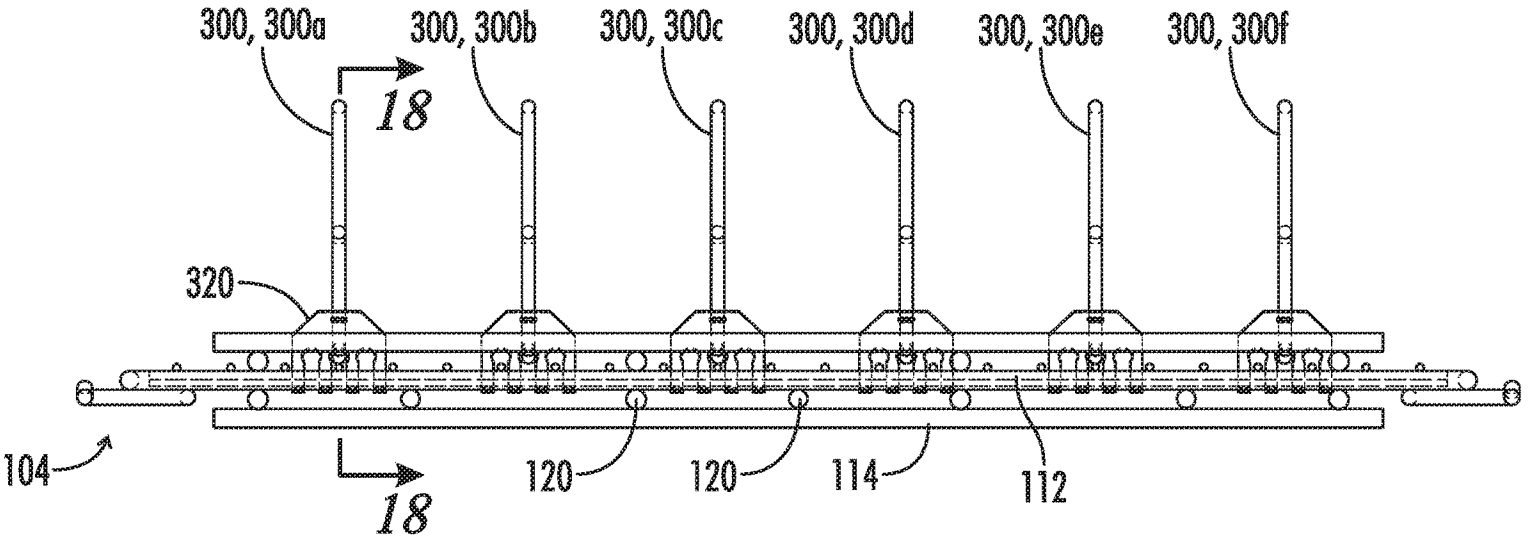
FIG. 17 illustrates a front elevational view of the shelf divider apparatus of the shelving system of FIG. 9 in conjunction with the shelf of the gravity-feed shelving system of FIG. 1.
Figure 18:
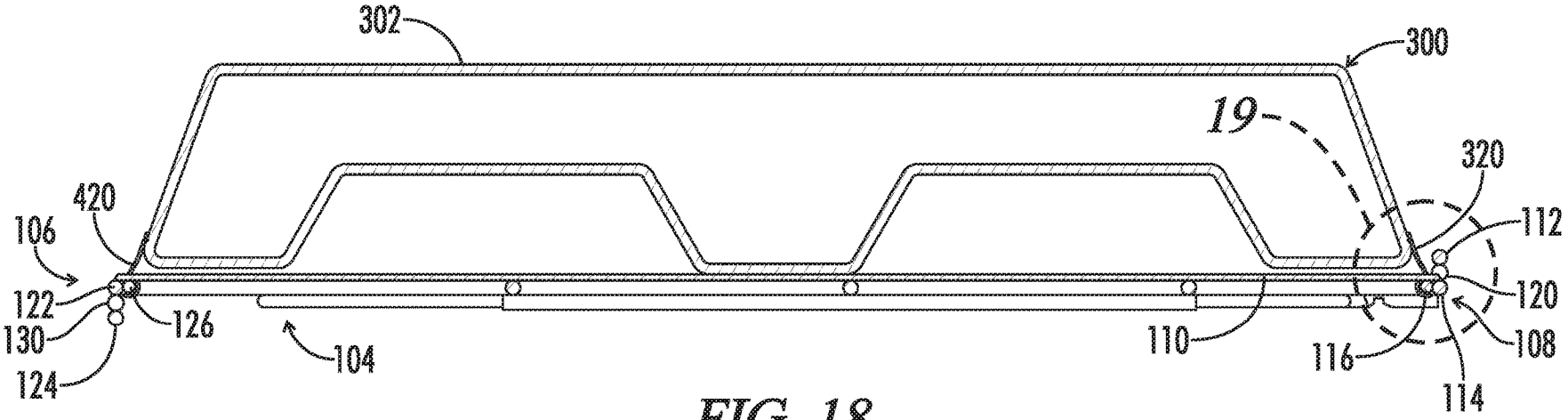
FIG. 18 illustrates a cross-sectional view of the shelf divider apparatus and the shelf of FIG. 17 taken along line 18-18 of FIG. 17.
Figure 19:
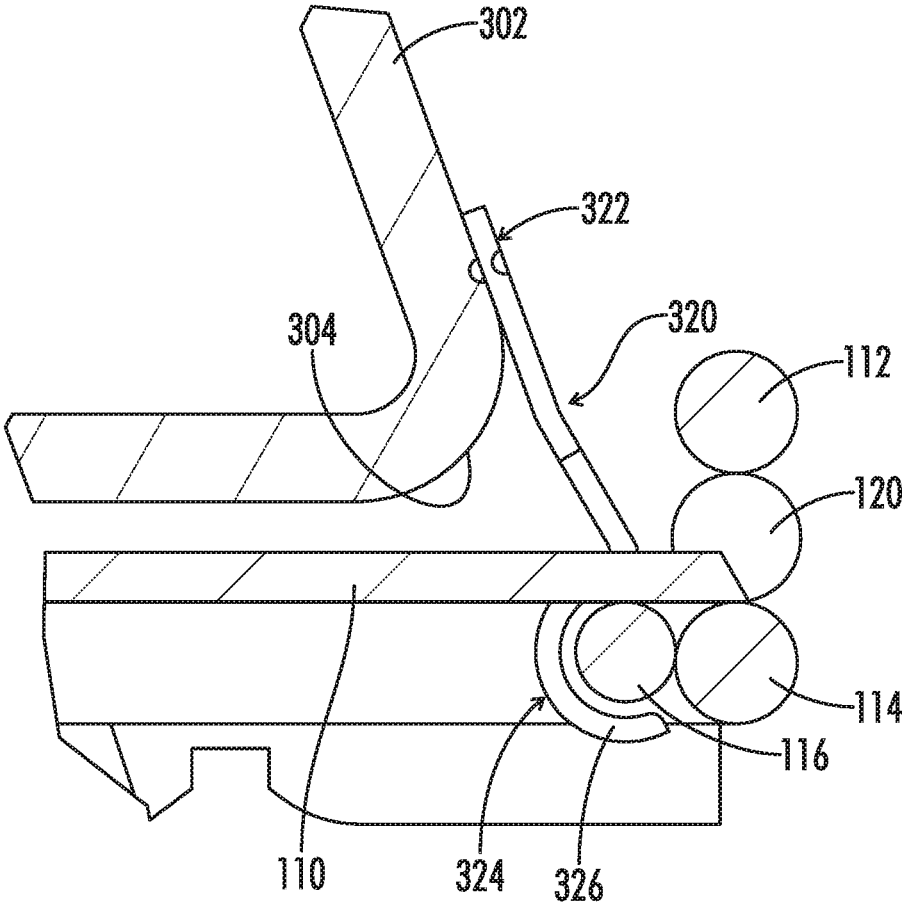
FIG. 19 illustrates an enlarged cross-sectional view of the shelf divider apparatus and the shelf of FIG. 17 taken of area 19 of FIG. 18.

Referring to FIGS. 17-19, the shelf divider apparatus 300, including the elongated divider 302, the first clip 320, and the second clip 420, is configured to be able to attach to the shelf 104 as described above. More specifically, the first and second clips 320, 420 are configured to be able to engage the front and rear retainer wires 116, 126, respectively. This allows the new shelf divider apparatus 300 to be compatible with both the shelf 104 and the shelf 204.

The previous detailed description has been provided for the purposes of illustration and description. Thus, although there have been described particular embodiments of a new and useful invention, it is not intended that such references be construed as limitations upon the scope of this invention except as set forth in the following claims.

The invention claimed is:

1. A shelving system comprising:

a shelf including a front top rail, a front bottom rail, a first plurality of balls separating the front top rail and the front bottom rail, and a plurality of support wires supported on the front bottom rail, the plurality of support wires being parallel to each other and spaced apart;

an elongated divider including a first divider end and a second divider end, the elongated divider including a divider length defined between the first and second divider ends; and a first clip connected to and extending below and away from the first divider end of the elongated divider, the first clip including at least an upper portion and a lower portion, the upper portion connected to the first divider end, the lower portion including a plurality of receivers directed away from the elongated divider and configured to engage the front bottom rail, the plurality of receivers spaced apart perpendicularly relative to the divider length to define straight slots between adjacent receivers of the plurality of receivers, each straight slot including a slot entrance and a slot width, each straight slot further including an enlarged opening, each enlarged opening spaced apart from the slot entrance of each straight slot and including an opening width larger than the slot width.

2. The shelving system of claim 1, wherein:

each enlarged opening is configured to accommodate at least a portion of one ball of the first plurality of balls so that the plurality of receivers engage the front bottom rail.

3. The shelving system of claim 2, wherein:

each enlarged opening is partially circular so that it is configured to clear a portion of one ball of the first plurality of balls.

4. The shelving system of claim 1, wherein:

the slot width is greater than or equal to 3 mm and is less than or equal to 13 mm.

5. The shelving system of claim 1, wherein:

the opening width of the enlarged opening is greater than or equal to 4 mm and is less than or equal to 14 mm.

6. The shelving system of claim 1, wherein:

adjacent wires of the plurality of support wires of the shelf are evenly spaced apart by a wire spacing width;

each receiver of the plurality of receivers includes a receiver width parallel to the slot width; and a summation of the slot width and the receiver width of one of the plurality of receivers is substantially equal to the wire spacing width.

7. The shelving system of claim 1, wherein:

the straight slots defined by adjacent receivers of the plurality of receivers are configured to receive adjacent support wires of the plurality of support wires.

8. The shelving system of claim 1, wherein:

the divider length defines a lengthwise direction; and the upper portion of the first clip extends from the first divider end of the elongated divider at a first angle relative to the lengthwise direction so that the upper portion engages a lower rail portion of the front top rail.

9. The shelving system of claim 8, wherein:

the first clip includes an intermediate portion defined between the upper and lower portions of the first clip;

the intermediate portion extends at a second angle relative to the lengthwise direction, the second angle being greater than the first angle; and a majority of each enlarged opening is defined along the intermediate portion so that the enlarged opening is positioned for receiving one ball of the first plurality of balls.

10. The shelving system of claim 9, wherein:

each receiver of the plurality of receivers includes a receiver opening directed away from the elongated shelf; and the receiver opening is positioned at a third angle relative to the lengthwise direction, the third angle being less than the first angle.

11. The shelving system of claim 1, wherein:

the plurality of receivers are configured to span between an upper rail portion of the front bottom rail and a lower rail portion of the front bottom rail.

12. The shelving system of claim 1, wherein:

the shelf further includes a rear top rail, a rear bottom rail, and a second plurality of balls separating the rear top rail and the rear bottom rail, the plurality of support wires supported on the rear bottom rail; and the elongated divider further includes a second clip connected to and extending below and away from the second divider end of the elongated divider, the second clip configured to engage the rear bottom rail.

13. The shelving system of claim 12, wherein:

the second clip extends opposite the first clip; and the second clip is connected to and extends below and away from the second divider end of the elongated divider, the second clip includes at least an upper portion and a lower portion, the upper portion connected to the second divider end, the lower portion includes a plurality of receivers directed away from the elongated divider and configured to engage the front bottom rail, the plurality of receivers are spaced apart perpendicularly relative to the divider length to define straight slots between adjacent receivers of the plurality of receivers, each straight slot includes a slot entrance and a slot width, each straight slot further includes an enlarged opening, each enlarged opening is spaced apart from the entrance of each straight slot and includes an opening width larger than the slot width.

14. A shelf divider apparatus comprising:

an elongated divider including a first end, a second end, and a divider length defined between the first and second ends; and a first clip connected to the first end of the elongated divider and extending below and away from the first end of the elongated divider, the first clip including a plurality of C-shaped receivers positioned along a lower portion of the first clip facing away from the elongated divider, the plurality of C-shaped receivers spaced apart perpendicularly relative to the divider length to define straight slots between adjacent C-shaped receivers of the plurality of C-shaped receivers, each straight slot including a slot entrance and a slot width, a partially circular opening in communication with each straight slot, each partially circular opening being spaced apart from the entrance of each straight slot and having an opening diameter greater than the slot width.

15. The shelf divider apparatus of claim 14, wherein:

the plurality of C-shaped receivers are offset perpendicularly by an offset distance from a plane defined along a first lower edge of the elongated divider adjacent to the first end.

16. The shelf divider apparatus of claim 15, wherein:

the offset distance is greater than or equal to 4 mm.

17. The shelf divider apparatus of claim 14, wherein:

the plurality of C-shaped receivers are offset perpendicularly by an offset distance from a plane defined tangential to the first end of the elongated divider and perpendicularly to the divider length.

18. The shelf divider apparatus of claim 17, wherein:

the offset distance is greater than or equal to 4 mm.

19. The shelf divider apparatus of claim 14, wherein:

the slot width of the straight slot is greater than or equal to 3 mm and less than or equal to 13 mm.

20. The shelf divider apparatus of claim 14, wherein:

the opening diameter of the partially circular opening is greater than or equal to 4 mm and less than or equal to 14 mm.

* * * * *